US006786051B2

(12) United States Patent
Kristich et al.

(10) Patent No.: US 6,786,051 B2
(45) Date of Patent: Sep. 7, 2004

(54) TRAILER MOUNTED MOBILE POWER SYSTEM

(75) Inventors: David Kristich, Hobe Sound, FL (US); Brian D. Hulse, Stuart, FL (US)

(73) Assignee: Vulcan Advanced Mobile Power Systems, L.L.C., Elizabethtown, NC (US)

( * ) Notice: Subject to any disclaimer, the term of this patent is extended or adjusted under 35 U.S.C. 154(b) by 118 days.

(21) Appl. No.: 10/055,827

(22) Filed: Oct. 26, 2001

(65) Prior Publication Data

US 2003/0079479 A1 May 1, 2003

(51) Int. Cl.[7] ..... F02C 6/00
(52) U.S. Cl. ..... 60/796
(58) Field of Search ..... 60/796, 976

(56) References Cited

U.S. PATENT DOCUMENTS 3,791,682 A * 2/1974 Mitchell ..... 290/2
4,057,371 A * 11/1977 Pilarczyk ..... 417/409
RE30,280 E * 5/1980 Berman et al. ..... 290/1 R
5,121,600 A * 6/1992 Sanders et al. ..... 60/39.464
5,626,103 A * 5/1997 Haws et al. ..... 122/235.14
6,334,746 B1 * 1/2002 Nguyen et al. ..... 410/44
6,487,508 B1 * 11/2002 Suzuki et al. ..... 702/61
2003/0057704 A1 * 3/2003 Baten et al. ..... 290/3

* cited by examiner

*Primary Examiner*—Ted Kim
(74) *Attorney, Agent, or Firm*—Morrison & Foerster LLP

(57) ABSTRACT

A trailer mounted mobile power generation system provides electrical power at locations where it is needed, either separate from or as a supplement to power from an electrical power distribution grid. A jet engine, a free turbine and an electrical power generator in a single common road transportable trailer. The trailer complies with weight and height limitations imposed by transportation authorities. The jet engine drives the turbine, which in turn drives the electrical power generator. Power levels on the order of 20 megawatts are generated while maintaining noise and combustion product emission levels within presently specified regulatory limits.

5 Claims, 5 Drawing Sheets

TRAILER MOUNTED MOBILE POWER SYSTEM

BACKGROUND OF THE INVENTION

1. Field of the Invention

The present invention relates to generation of electrical power, and more particularly to trailer mounted, mobile systems for generation of electrical power.

2. Description of the Related Art

Mobile power generation systems capable of delivering several or more megawatts of power have been known to offer certain advantages compared to power delivered from the electrical power or utility distribution grid. The mobile power generation systems can provide power as needed at times of peak demand or of brownout in the distribution grid, or in cases of need because of some emergency or other problem in the distribution grid as a result of a power grid failure or some other type of disaster. The mobile power generation systems also can be located at places distant from the distribution network where there is a need for power. There is then no need for the delay or expense of arranging for or construction of power lines to the distant or remote places.

Some years ago, there were attempts made to provide electric power in trailer mounted generator systems. An example of such a trailer mounted generator system is described in a magazine article entitled "Megawatts on Wheels" written by C. F. Thompson, C. R. Boland and E. Bernstein in the March 1971 issue of Combustion, pages 24–30. For some reason, these types of generator systems did not, so far as is known, achieve any extended years of use and were not widely adopted.

As noted above, mobile power generation systems have certain desirable features and advantages. They have again recently become the subject of interest. However, there are a number of intervening factors which give rise to problems with these earlier types of trailer mounted generator systems.

For optimum use, such a system needs to comply with weight and height restrictions from relevant highway regulatory and governmental agencies. Also, there are environmental limitations on the type and acceptable concentration levels of combustion waste products produced by this equipment. In addition, noise from the various components of the generator systems must be kept within presently established regulatory limits.

There were competing considerations regarding mobile power generation systems of this type. On the one hand, limits on weight and size of the systems had to be observed if the systems were to be highway transportable and thus available for widespread use. In conflict with this were the environmental and noise abatement considerations. Further, mobile power generation systems should be self-supporting in that they could bring to the site all equipment necessary to assemble the system in a relatively few days without the need for other equipment such as cranes, hoists and the like. It was felt by at least some that achieving suitable limits on combustion gas product emissions and noise levels could not be achieved while complying with height and weight limits for highway travel.

SUMMARY OF THE INVENTION

Briefly, the present invention provides a new and improved mobile, trailer-mounted power generation system. A gas generator burning a hydrocarbon fuel for creation of combustion gases is operably interconnected with a free turbine which receives combustion gases and rotates a turbine shaft in response thereto. An electrical generator is mounted in communication with the free turbine for the generation of electricity upon rotation of the turbine shaft. A trailer body which is towable by a conventional tractor or truck is provided having a floor on which the gas generator, free turbine and electrical generator are mounted. The trailer body has end and side walls and a roof enclosing the gas generator, free turbine and electrical generator.

The trailer body is provided with an air inlet near one end for passage of air to the gas generator, and the free turbine has an exhaust for exit of the combustion gases. The trailer body has a combustion gas outlet formed in a side wall thereof for exit of the combustion gases from the free turbine. The gas generator, free turbine and electrical generator each have a longitudinal axis about which certain of their power generating components rotate during their operation. The longitudinal axes of the gas generator, free turbine and electrical generator are longitudinally aligned along a common axis along the longitudinal extent of the floor of the trailer body.

With the present invention, the mobile, trailer-mounted power generation system is easily connectable to other road transportable units which provide for removal of undesirable components of the combustion gases without increasing the height or width of the trailer body of the power generation system. The mobile, trailer-mounted power generation system permits modularization of components to achieve generation of electrical power from a road transportable unit while complying with height and weight limits for highway travel and also meeting both noise and environmental requirements.

DETAILED DESCRIPTION OF THE PREFERRED EMBODIMENTS

Figure 1:
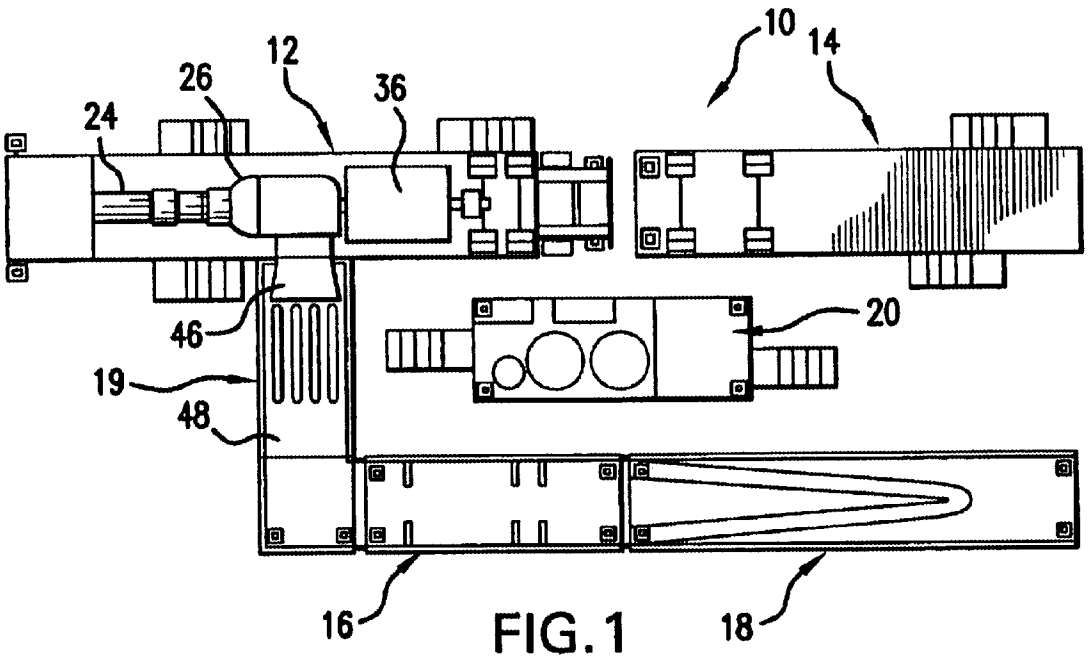
FIG. 1 is a plan view of a mobile, trailer-mounted electrical power generation system according to the present invention deployed with a number of support trailers at a power generation site.

Referring first to FIG. 1, there is shown in plan view an exemplary mobile power production installation 10 that has been established at a desired power generation site, either remote or in connection with an established power generation network or grid in order to provide electrical power. The exemplary installation 10 includes several trailer systems 12, 14, 16, 18, 19 and 20, each in the form of an enclosed trailer. At the power generation or deployment site, the trailers are supported on jacks in appropriate level positions. Access to the interior of trailers 12, 14 and 20 through conventional, lockable doors is provided by as set of steps S, ladders or the like.

Trailer system 12 is a mobile power generation system according to the present invention to be described in further detail below. Trailer 12 is a size compatible with applicable highway transport regulations, 10 ft., 6 in. in width, 13 ft., 6 in. in height and 55 ft. long for road travel. Trailer 14 is a controls trailer that houses controls used to monitor and control the operation of the power generation equipment within the trailer 12. Trailers 16, 18 and 19 enclose equipment that is used to remove undesirable emissions from the combustion gases formed by the components of trailer 12, such as NOx, CO and the like. In the preferred embodiment, this is accomplished through the use of selective catalytic reduction ("SCR") of the emissions.

Trailer 16 contains an injection chamber where treating chemicals are injected into the stream of exhaust combustion gases entering from trailer 12. Trailer 18 contains a mixing chamber where the exhaust combustion gases and injected chemicals enter and are thoroughly mixed. Trailer 19 contains a reaction chamber where the mixed products enter from the mixing chamber in trailer 18 and are contacted by reduction catalysts suitably disposed to contact the entering gas mixture and react with the indesirable combustion gas products. An outlet is provided in the reaction chamber trailer 19 for venting of the treated exhaust gases to the atmosphere. The SCR techniques may, for example, be those according to U.S. Pat. Nos. 5,601,792 and 5,431,893, which are incorporated herein by reference. Trailer 20 is used to store chemicals and other supplies and to house mixing tanks for forming the urea solution injected into trailer 16 in the SCR process to clean the combustion gas emission stream from trailer 12.

Figure 3:
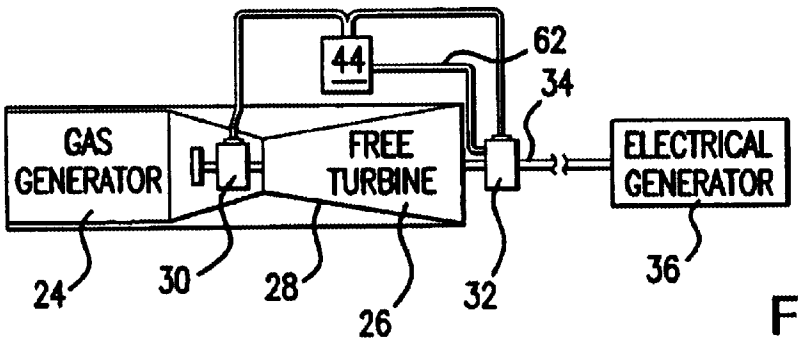
FIG. 3 is a schematic representation in plan view of the interrelation of several components within the power generation system shown in FIGS. 1 and 2.
Figure 2:
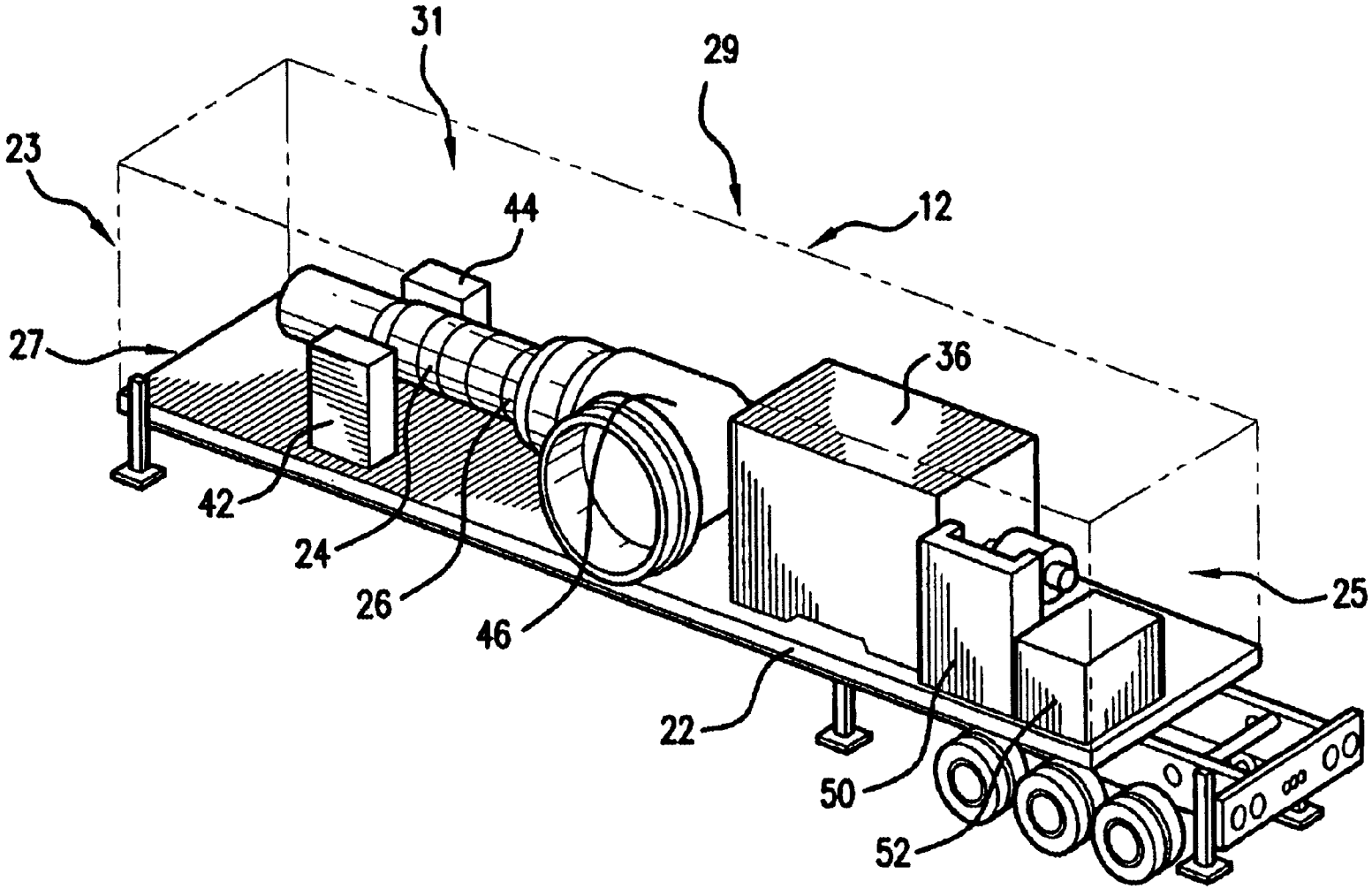
FIG. 2 is an isometric view of the mobile, trailer-mounted electrical power generation system of FIG. 1.

FIG. 2 illustrates an exemplary mobile power generator system trailer 12 with trailer having a floor 22, end walls 23 and 25, side walls 27 and 29 and a roof 31. Walls 23, 25, 27 and 29 and roof 31 are shown in phantom so that the power generating components of the trailer 12 may more clearly be seen. FIG. 3 illustrates certain components of the system of FIG. 2 schematically to illustrate their functional interconnection more clearly. It is noted that the generator system trailer 12 forms a complete and essentially closed system for the generation of electrical power.

Figure 5:
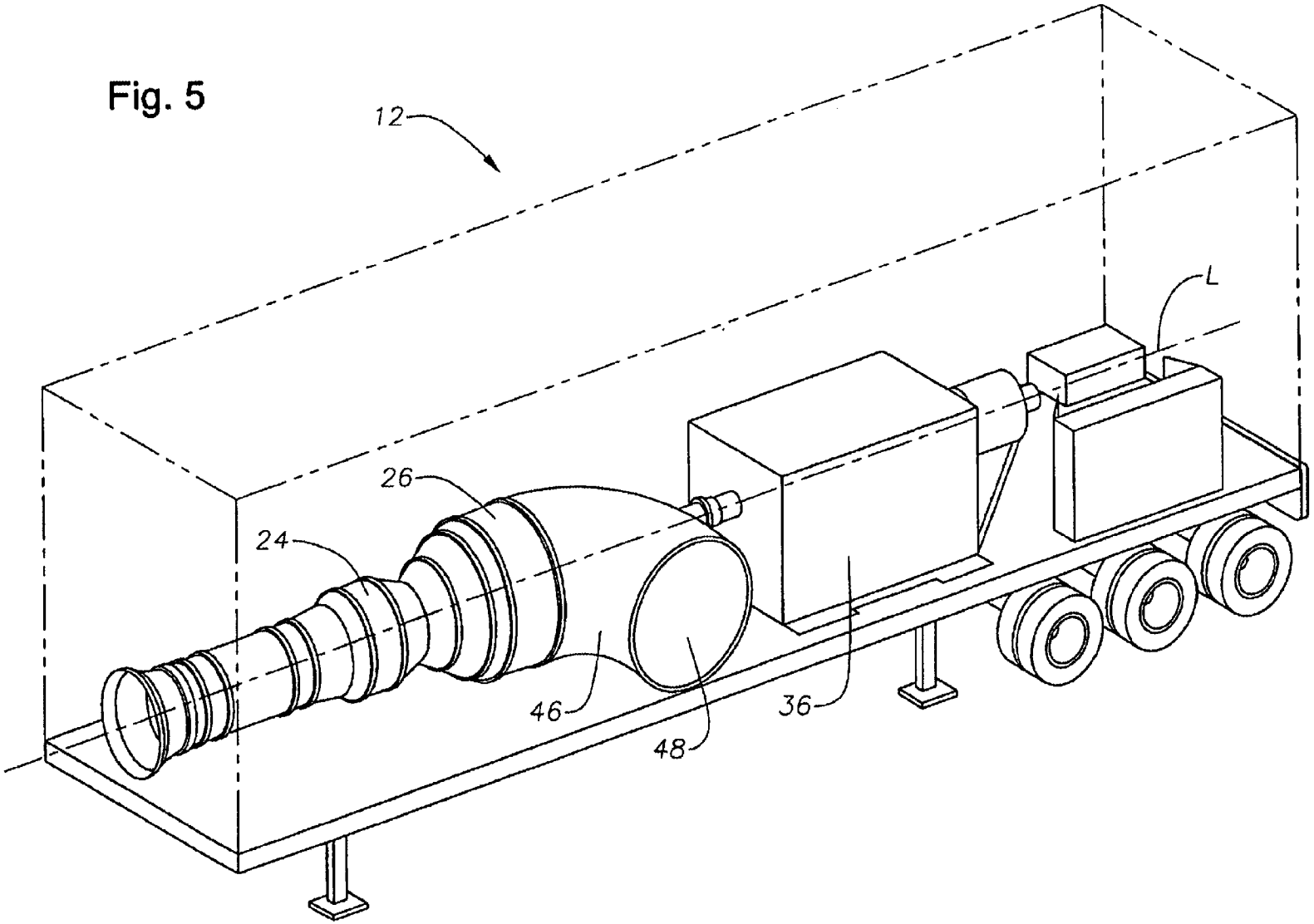
FIG. 5 is an isometric view of another embodiment of a mobile, trailer-mounted electrical power generation system of the present invention.
Figure 6:
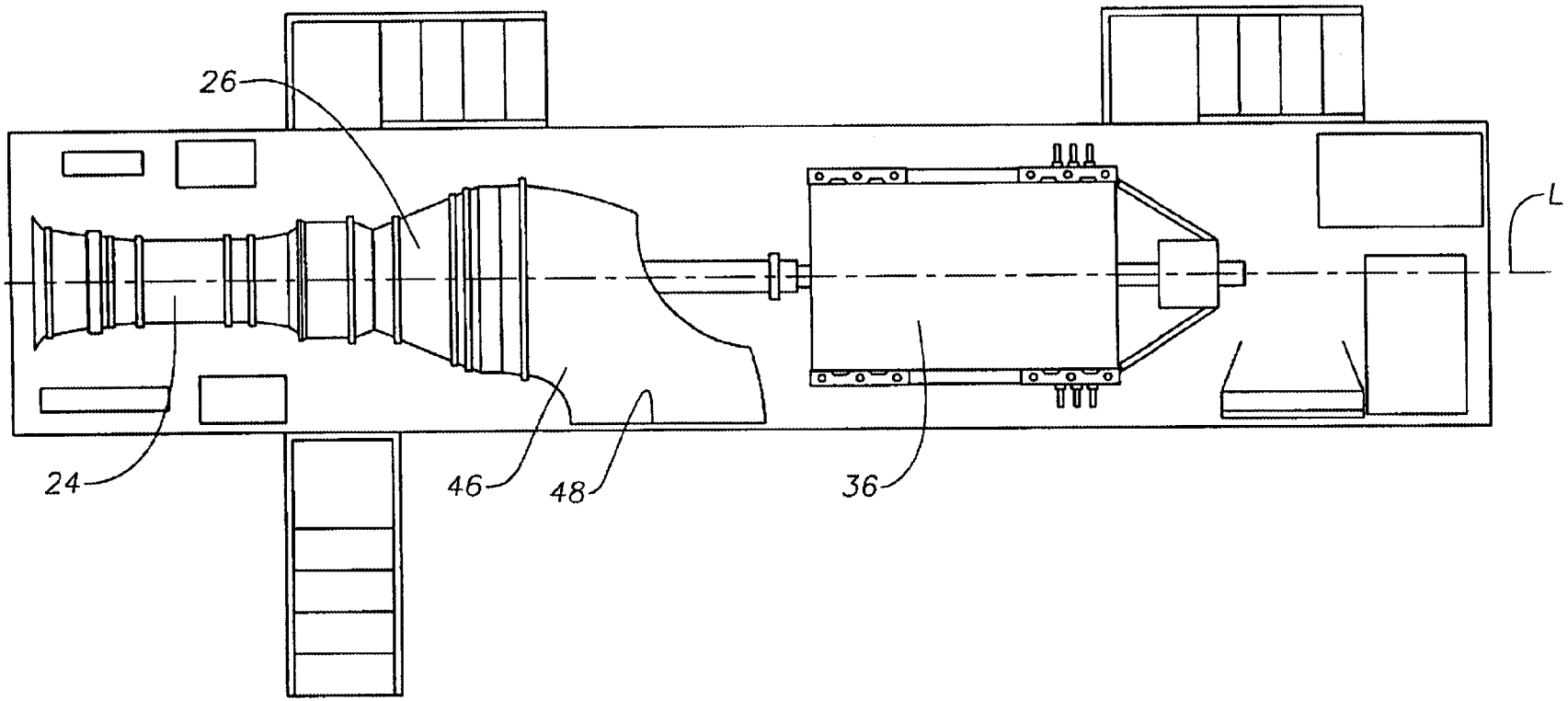
FIG. 6 is a schematic representation in plan view of the mobile, trailer-mounted electrical power generation system of FIG. 5.

The power generator system trailer 12 includes a gas generator 24 operably interconnected with a power generation turbine, or "free" turbine, 26 to supply combustion exhaust gases to the free turbine 26. The gas generator 24 preferably comprises a Pratt & Whitney FT-4 gas generation unit positioned lengthwise on the trailer 12 along a common longitudinal axis L of rotation of the rotating power generation components of the gas generator 24 and free turbine 26 mounted on the trailer floor 22. The FT-4 of gas generator 22 is a relatively lightweight aircraft gas turbine which receives fuel (either natural gas or liquid fuel such as jet fuel or diesel) from a conventional storage tank or other source of supply (not shown). The gas generator 22 burns the fuel provided it to form exhaust combustion gases which are furnished to the free turbine 26 through an enclosed cylindrical hood or gas passage. The cylindrical passage or duct for the combustion exhaust gases from the gas generator 24 extends between the outlet of gas generator 24 rearward of its guide vanes to an inlet of the free turbine 26 forward of its nozzle guide vanes. In the embodiment of FIGS. 1–3, the free turbine is Model FT-4 gas turbine originally made by Pratt and Whitney Aircraft and available from various sources. In the embodiment of FIGS. 5 and 6, the free turbine is a "Zorya" PA gas turbine, Model UGT-2500 available through ZDRYA Power (USA) of Annapolis, Md.

The power generation turbine 26 is known as a "free" turbine because the shaft of the turbine 26 is not mechanically interconnected with a shaft within the gas generator 24. Thus, the turbine 26 is powered by the exhaust combustion gases formed by the gas generator 24. The free turbine 26 includes a shaft supported by a front and a rear bearing 30, 32 (see FIG. 3) and having turbine blades mounted therewith to develop rotational movement in response to receipt of the gases from gas generator 24. The free turbine 26 also has an output shaft 34 that is operably interconnected with an electrical generator 36. The generator 36 is capable of converting the rotational energy of the output shaft 34 into electrical power. A suitable device for use as the electrical generator 36 is a Peebles 3-phase, 13,800 KVA brushless, air-cooled 25 MW generator. It will be understood that the generator 36 is operably interconnected in a cabinet C with power cables or other electrical transmission means for the supply of electrical power created by the generator 36.

The transport trailer 22 also supports a gas generator air intake through which external air is supplied to provide a combustion mix in the gas generator 24 with the fuel supplied it. A free turbine oil cooler intake is likewise mounted upon the trailer 22 when the system 12 is set up for power generation. A gas turbine lubrication system 42 is operably interconnected with the gas generator 24 to supply lubricant thereto, while a free turbine lubrication system 44 is operably interconnected with the free turbine 26 in order to supply lubricant to the free turbine 26.

A L-shaped exhaust elbow 46 is disposed between the free turbine 26 and the electrical generator 36 so that exhaust gases exiting from the free turbine 26 are diverted away from the generator 36 for processing. FIG. 1 illustrates the elbow 46 interconnected with a cylindrical outlet port 48 that is, in turn, secured in sealing engagement with an inlet port 50 to the injection chamber trailer 16. As has been set forth, the injection chamber trailer 16, mixing chamber trailer 18 and reaction chamber trailer 19 receive the effluent combustion gases from the power generator trailer 12 so that the exhaust combustion gases may be treated to reduce undesirable emissions such as NOx, CO and the like to environmentally acceptable levels.

The exhaust elbow 46 is in the form of a generally L-shaped outwardly expanding tubular member connected at the outlet of the free turbine 26 to receive exhaust combustion gases and divert and convey these gases from their original axis of travel along the longitudinal axis L of flow through the gas generator 24 and free turbine 26 at a laterally outwardly extending angle A, preferably perpendicularly at an angle of 90° to the longitudinal axis L. The gases diverted in exhaust elbow 46 exit outwardly through the outlet port 48 formed in one of the side walls 27 or 29 of trailer 12.

Figure 4:
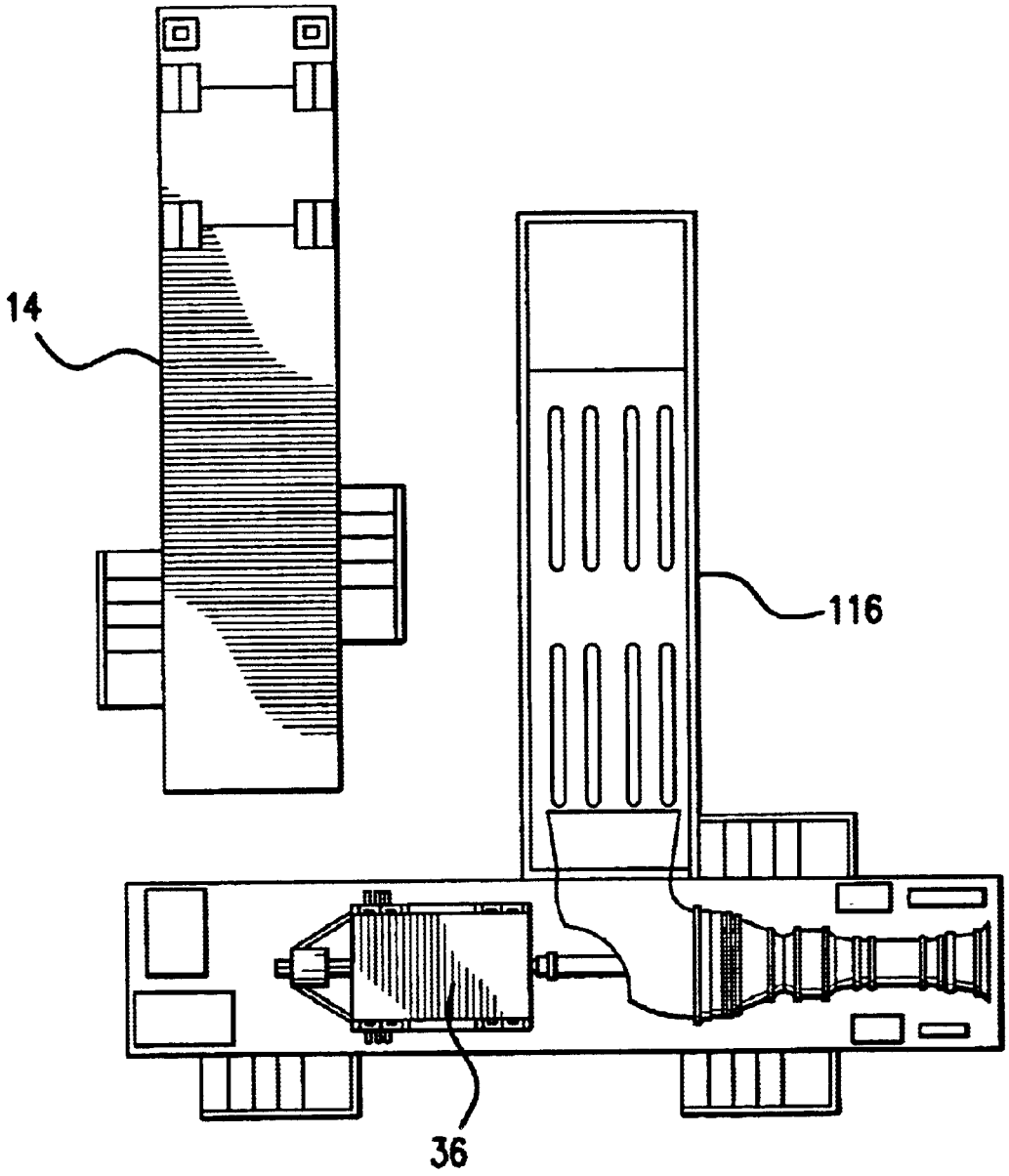
FIG. 4 is plan view of an alternate deployment to that of FIG. 1 of a mobile, trailer-mounted electrical power generation system according to the present invention at a power generation site.

It is to be noted that the exhaust combustion gases from the free turbine 26 and gas generator 24 are vented laterally through a side wall 27 or 29 and not upwardly through the roof 32 of the power generator trailer. This permits connection of the trailer 12 at its own elevation to various configurations of emission treatment equipment, noise abatement equipment and the like. For example, FIG. 4 shows the trailer 12 connected at its outlet port 48 to a modified exhaust gas treatment trailer 116 which can provide a simplified SCR treatment of the type discussed above in the present application. Other structure in FIG. 4 like that of FIGS. 1–3 bears like reference numerals. With prior roof-mounted outlets from the earlier free turbine systems, a crane and other expense would have been required to establish any connection. This would have involved additional expense in equipment and time. Thus the present invention provides a mobile, trailer-mounted power generation system which is road transportable to a deployment site where electrical power generation is required. Further, the trailer 12 meets applicable highway regulatory size limits and is connectable at the power generation site to emission control equipment and noise abatement equipment also mounted in trailers without the need for cranes, booms or other special purpose construction equipment.

Those of skill in the art will recognize that many changes and modifications may be made to the devices and methods of the present invention without departing from the scope and spirit of the invention. Thus, the scope of the invention is limited only by the terms of the claims that follow and their equivalents.

What is claimed is:

1. A mobile, trailer-mounted power generation system comprising:

a gas generator burning a hydrocarbon fuel for creation of combustion gases;

a free turbine operably interconnected with the gas generator as a first turbine stage to receive combustion gases and rotate a turbine shaft in response thereto;

an electrical generator in communication with the free turbine for the generation of electricity upon rotation of the turbine shaft;

a trailer body having a floor on which the gas generator, free turbine and electrical generator are mounted, end and side walls and a roof;

the gas generator, free turbine and electrical generator each having a longitudinal axis about which their components rotate during their operation;

the longitudinal axes of the gas generator, free turbine and electrical generator being longitudinally aligned along a common axis along the longitudinal extent of the floor of the trailer body;

the trailer body having an air inlet near one end for passage of air to the gas generator;

the free turbine having an exhaust for exit of the combustion gases; and the trailer body having a combustion gas outlet formed in a side wall thereof for exit of the combustion gases.

2. The power generation system of claim 1 wherein the gas generator comprises a jet engine.

3. The power generation system of claim 1 wherein the free turbine comprises a UGT 2500 turbine.

4. The power generation system of claim 1 wherein the free turbine comprises a FT-4 turbine.

5. The power generation system of claim 1, further including an elbow member turning the flow of combustion gases from the longitudinal axis of the free turbine to exit from the gas outlet in the side wall of the trailer body.

* * * * *